US005934123A

United States Patent [19]

Eldredge

[11] Patent Number: 5,934,123

[45] Date of Patent: Aug. 10, 1999

[54] EASY ACCESSIBLE KEY CHAIN

[76] Inventor: Eleanore C. Eldredge, 3001 S. 288th St. Space 76, Federal Way, Wash. 98003

[21] Appl. No.: 09/070,818

[22] Filed: Apr. 30, 1998

Related U.S. Application Data

[60] Provisional application No. 60/056,998, Aug. 26, 1997.

[51] Int. Cl.[6] ..... A47G 29/10

[52] U.S. Cl. ..... 70/456 R; 70/457

[58] Field of Search ..... 70/456 R, 457–460; 206/37, 37.1, 38, 38.1, 305, 37.4, 37.5, 37.6, 37.7, 37.8; 24/3.6

[56] References Cited

U.S. PATENT DOCUMENTS

| | | | |
|---|---|---|---|
| 452,830 | 5/1891 | Bowie et al. | 70/457 |
| 726,781 | 4/1903 | Stone | 70/458 |
| 946,119 | 1/1910 | Field | 206/37.8 |
| 1,053,626 | 2/1913 | Miller | 70/457 |
| 1,423,280 | 7/1922 | Urich | 70/457 |
| 1,581,875 | 4/1926 | Salvog | 70/459 |
| 1,598,988 | 9/1926 | Rosenthal | 206/37.6 |
| 1,621,777 | 3/1927 | Gladstone | 206/37.4 |
| 1,814,710 | 7/1931 | Komorous | 70/457 |
| 2,065,036 | 12/1936 | Townsend, Jr. | 70/456 R |
| 2,086,468 | 7/1937 | Bryan | 70/457 |
| 2,218,932 | 10/1940 | Collins | 70/456 R |
| 2,224,721 | 12/1940 | Chernow | 70/459 |
| 2,227,419 | 1/1941 | Anderson et al. | 70/459 |
| 2,479,524 | 8/1949 | Tarbox | 206/37.4 |
| 2,522,516 | 9/1950 | Jablon | 70/457 |
| 2,557,970 | 6/1951 | Jablon | 70/457 |
| 2,656,871 | 10/1953 | Anderson | 206/37.5 |
| 3,257,696 | 6/1966 | Miller et al. | 70/456 R |
| 3,600,917 | 8/1971 | Krock | 70/457 X |
| 3,779,053 | 12/1973 | Langwell | 70/457 X |
| 3,978,902 | 9/1976 | Adkison | 70/456 R X |
| 4,359,888 | 11/1982 | Scheineman | 70/457 |
| 4,765,459 | 8/1988 | Edwards | 70/456 R X |

FOREIGN PATENT DOCUMENTS

| | | | |
|---|---|---|---|
| 453606 | 6/1913 | France | 206/37.1 |
| 1293230 | 4/1962 | France | 70/458 |

*Primary Examiner*—Lloyd A. Gall
*Attorney, Agent, or Firm*—Dilbert J. Barnard

[57] ABSTRACT

In a key holder (10), a first flexible member (12) includes a first free end (14) and a second end (42). A second flexible member (12) has a first free end (16) and a second end (42). A third flexible member (30) has a first free end and a second end (42). A first key ring (20) is connected to the free end (14) of the first flexible (12). A second key ring (20) is connected to the free end (16) of the second flexible member (12). A handle (28) is connected to the free end of the first flexible member (30). The second ends (42) of the first, second and third flexible members are connected together at a hub (52). A third key ring (32) is connected to the flexible members generally at the hub (52). In use, the key holder (10) may be suspended from the third key ring (32) and the first, second and third flexible members (12, 12, 30) will hang from the hub (52) adjacent each other (FIG. 4). The first, second and third flexible members (12, 12, 30) are sufficiently long that the first (12) and second (12) flexible members, and the first, second and third key rings (20, 20, 32), can be positioned inside of a container (46), to be concealed within the container (46). The third flexible member (30) and the handle (28) can be positioned outside of the container (46), so that the handle is accessible for expedited removal of the key holder (10) and keys (18) from the container (46).

6 Claims, 4 Drawing Sheets

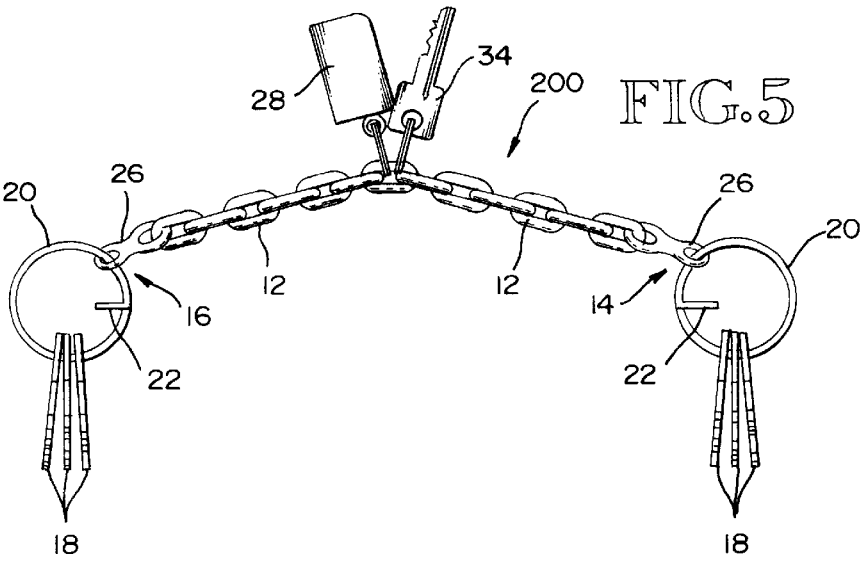
FIG. 5
FIG. 10
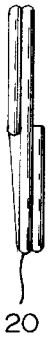
FIG. 3
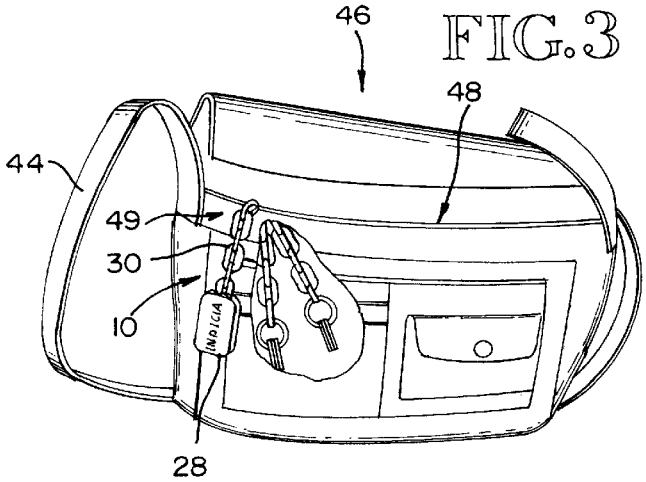
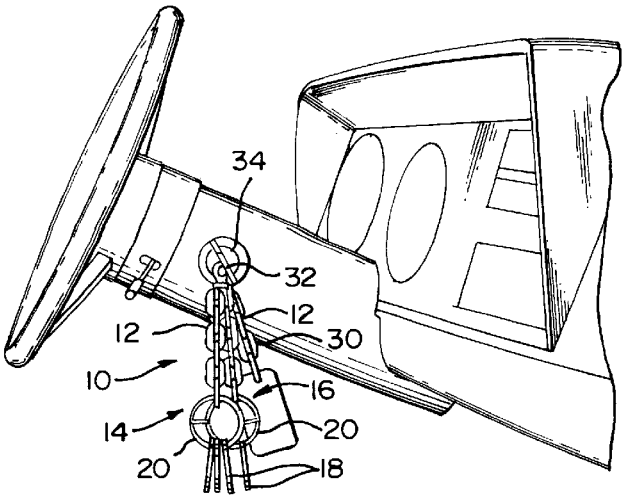
FIG. 4

FIG. 11
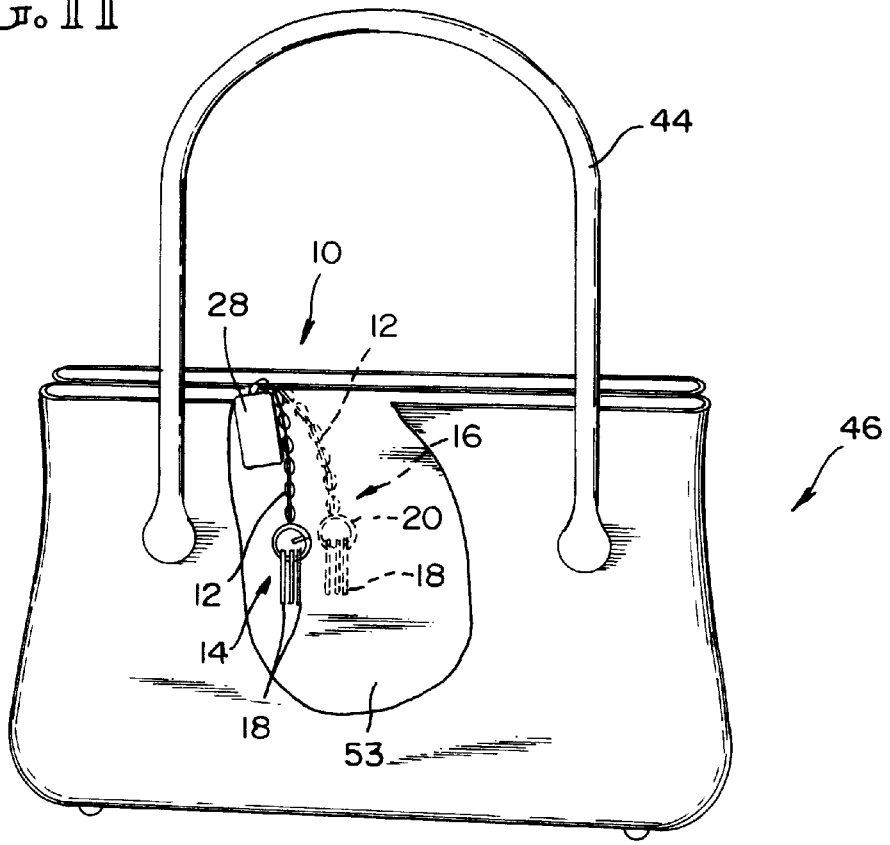
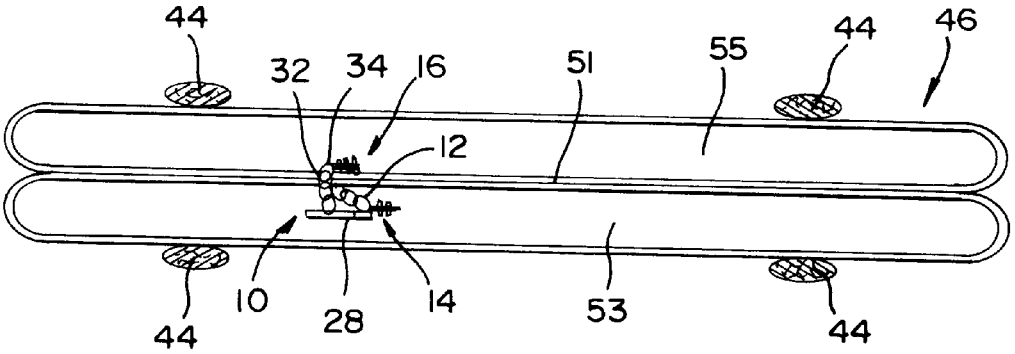
FIG. 12

EASY ACCESSIBLE KEY CHAIN

RELATED APPLICATIONS

This application claims priority to U.S. provisional patent application Ser. No. 60/056,998, filed Aug. 26, 1997.

TECHNICAL FIELD

The present invention relates to key chains, and more particularly, key chains that can be easily accessed while, simultaneously, hiding the keys from external view within a container, such as a purse.

BACKGROUND OF THE INVENTION

Key chains are a common necessity to everyone's daily lives. They are a form of key holder. Although attempts have been made to add security devices onto a key chain, such as a small can of mace or a whistle, little has been done to make the key chains readily accessible. Most women fumble through their purses to look for their keys. Not only is this annoying, especially if the user is stuck in inclement weather, but the lack of easy access to one's keys may be a real security threat given the rising risk of assault, robbery, and theft.

Some purse manufacturers have included a key ring on a beaded chain to extend around a handle, external of the purse, such as that made popular by the Coach Company. The problem with this approach is that the keys are still in plain view of everyone else. One who would steal a car would have an easier time by stealing accessible and visible car keys. As such, even though easy access to one's keys is strongly desired, it is also equally desired to have the keys be hidden from view.

It is an object of the present invention to provide an easily accessible key holder used in connection with a container that simultaneously hides the keys from external view until the keys are needed.

DISCLOSURE OF THE INVENTION

The present invention is directed to an easily accessible key chain used in connection with a container having a handle or with a container having a partition. The key chain includes an elongated flexible member having a first end and a second end. Both the first and second ends are of a size and shape to easily receive and easily remove at least one key.

The key chain also includes a generally central portion of the flexible member which is between the first and second end. The general central portion is sized such that, in use, the central portion is externally wrapped around the handle or over the partition. Both the first and second ends extend within the container and are hidden from external view. When the key chain needs to be accessed, the flexible member is easily removed from the handle or partition by lifting the externally-positioned central portion of the flexible member.

In a preferred embodiment, a pull-tab is attached to and extending outwardly from and generally centrally of the flexible member. In use, the pull-tab is positioned externally of the handle or over the partition of the container such that when accessing the key chain, the pull-tab is readily accessible to remove the flexible member and its first and second ends.

A second flexible member may be attached to the first flexible member on one end and to the pull-tab on the other end. Thus, the pull-tab is spaced apart from the first flexible member.

The pull-tab may include a space for indicia or other design. In another embodiment, the pull-tab may include a time display mechanism, such as a watch or digital display.

In another preferred embodiment, the key chain of the present invention may also include a connector that is attached to the flexible member and is of a size and shape to readily receive and remove at least one key, such as an ignition key. In preferred form, the connector is generally centrally located along the flexible member.

The position of the ignition key generally centrally of the (first) flexible member effectively folds the key chain in half when the ignition key is inserted into a car ignition. This mitigates interference of the key chain with the driver of the car during driving.

In another preferred embodiment, each end of the flexible member may further include a circular split ring. A finger may extend from the circular diameter inwardly toward the center of the split ring.

According to another embodiment of the invention, the key chain as described above may include a pull-tab of a size and weight to counterbalance the weight of flexible member, the first and second ends, and any keys received on the first and second ends. This is so when the pull-tab is placed externally of an upper edge of a container and the flexible member, first and second ends, and any said keys that are suspended within the container and hidden from external view. Here, the additional second flexible member connecting the pull-tab to the first flexible member adds weight to counterbalance the remaining key chain components.

The present invention encompasses a variety of embodiments to the key chain. For example, the key chain may include only the pull-tab and not the connector, or the key chain may only include the connector and not the pull-tab. Additionally, the pull-tab can be positioned adjacent the connector containing the ignition key in such a way that the ignition key is generally hidden from view by the pull-tab.

In yet another embodiment of the present invention, the invention also includes an embodiment directed to two key chains each having an elongated flexible member with a first end and a second end, each of a size and shape to receive at least one key. Generally centrally of the first key chain and the second key chain is a common connector that connects both the first key chain to the second key chain. In use, a central portion between the first and second member of each chain is wrapped externally around a handle or over a partition of a container such that both first and second key chains between the first and second ends are sized such that the central portions and the common connector externally wrap around the handle or over the partition of a container. Both ends of each key chain extend within the container and are hidden from external view. When the key chain needs to be accessed, the flexible members of both key chains are readily removed from the handle or partition by lifting the externally positioned common connector. In one embodiment, the common connector may be a decorative connector, such as a tassel.

These and other advantages, objects and features will become apparent from the following best mode description, the accompanying drawings, and the claims, which are all incorporated herein as part of the disclosure of the invention.

BRIEF DESCRIPTION OF THE DRAWINGS

Like reference numerals are used to designate like parts throughout the several views of the drawing, wherein:

FIG. 3 is a pictorial view like that of FIG. 2 except disclosing a second use where the key chain of the present invention is shown positioned over an upper edge of a container such that the pull-tab acts as a counterbalance weight to anchor the two ends and keys shown in cutaway within the container;

FIG. 4 is a pictorial view of the key chain where the ignition key connected to the connector of the present invention is inserted into the ignition of a car such that the flexible chain is folded essentially in half;

FIG. 5 is a front view of a first alternate embodiment of the present invention disclosing the pull-tab, less the second flexible member, and the ignition key/connector connected at virtually the same place as the pull-tab on the flexible chain in order to cover the ignition key with the pull-tab;

FIG. 10 is a side view of a split ring, which is the preferred shape of the ends as shown in FIGS. 1–9;

FIG. 11 is a pictorial view of a third use where the key chain of the present invention is used in connection with a container having a partition that separates the container into two openings on each side of the partition, and where the pull-tab and central portion of the key chain straddle over the partition such that one end and corresponding keys are shown in cutaway and suspended into one opening hidden from external view and the other end and corresponding keys are hidden in the other opening (shown in phantom); and FIG. 12 is a top plan view of FIG. 11.

BEST MODE FOR CARRYING OUT THE INVENTION

Figure 1:
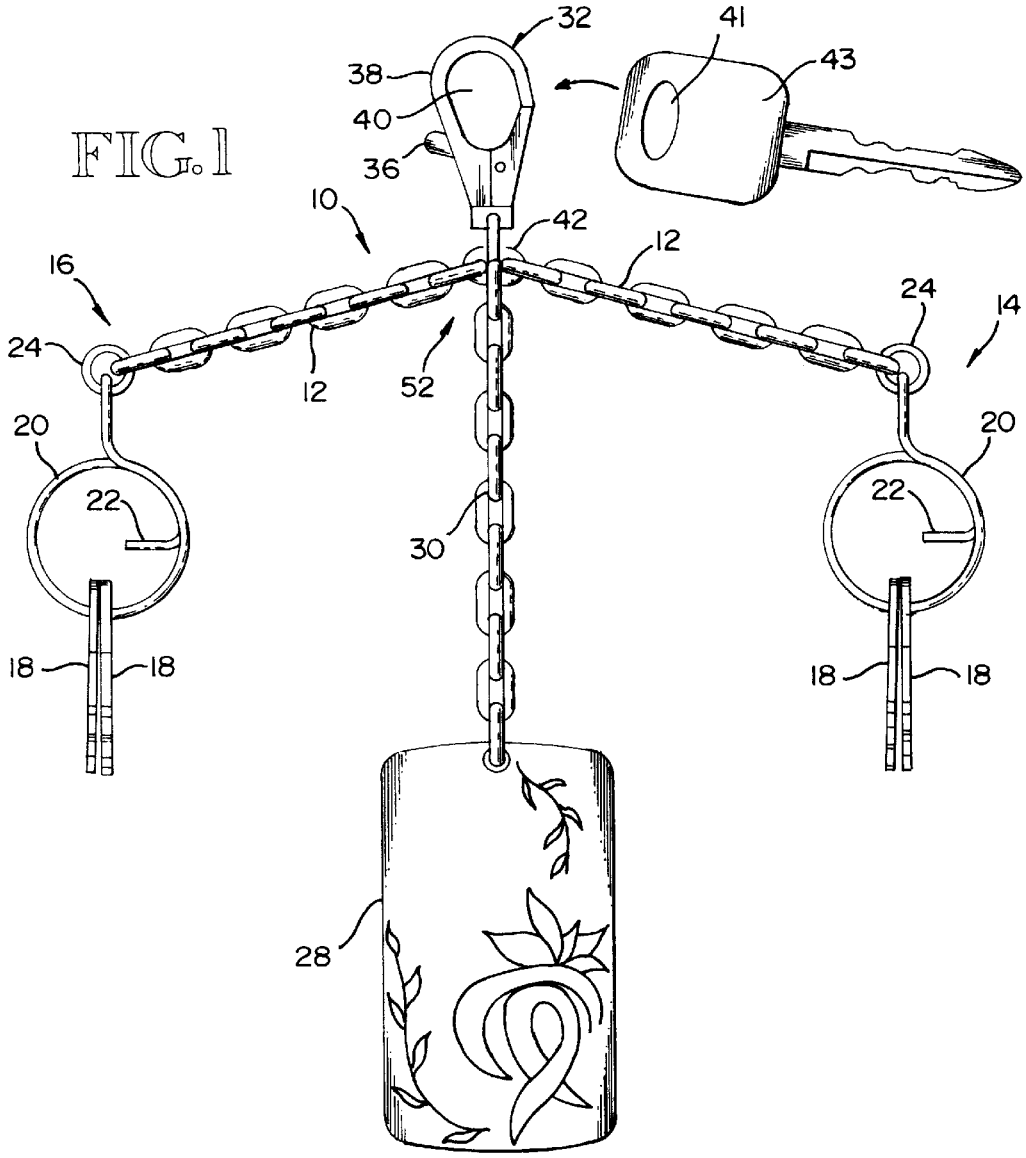
FIG. 1 is a front view of an easily accessible key chain of the present invention having a flexible chain with two ends that are of a size and shape to each receive at least one key, and with a centrally located pull-tab suspended generally centrally from the flexible chain by its own flexible chain, the present invention also discloses a generally centrally located connector to receive another at least one key, such as the ignition key as shown.
Figure 2:
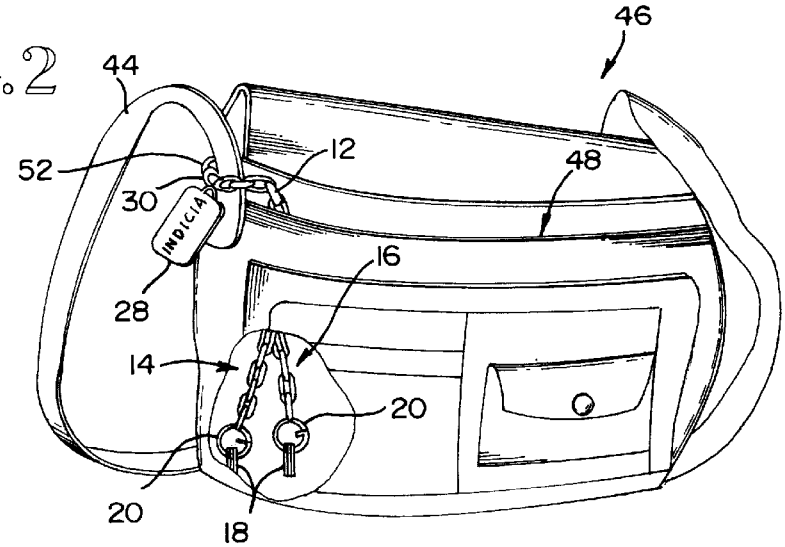
FIG. 2 is a pictorial view of the key chain of the present invention shown in one use where a central portion of the flexible member and the pull-tab are positioned externally of a handle of a handbag or other container and with a cutaway view of the two ends of the flexible member including any keys that are received on the two ends hidden from view within the container.

Referring to FIG. 1, the present invention is an easily accessible key chain 10 that has an elongated flexible member or chain 12 having two ends 14, 16. Each end 14, 16 is of a size and shape to easily receive and remove at least one key 18. Although any type end that can easily receive and remove at least one key may be used, preferably, and as shown in the drawings, each end 14, 16 includes a split ring 20.

Referring also to FIG. 10, split ring 20 is a circular ring having an inwardly projecting finger 22 that allows keys to be easily added to or removed from split ring 20. Finger 22 extends inwardly from the circular diameter toward the split rings' center. The addition of finger 22 acts as a guide to assist in adding or removing a key as well as to mitigate damage to the user's fingernails when adding or removing such a key.

Split ring 20 may be connected to flexible chain 12 by a ring 24, such as shown in FIG. 1 or a claw-style hook 26, such as shown in FIG. 5. Claw-style hook 26 can provide more flexibility to the user if the entire split ring 20 is desired to be removed from the key chain.

In a preferred embodiment, a pull-tab 28 is attached to and extends outwardly and generally centrally from flexible chain 12. Pull-tab 28 functions as an easily accessible device to pull in order to easily access the flexible member and, particularly, ends 14, 16, and any keys received on such ends. Pull-tab 28 also functions as a counterbalance weight, which will be discussed further below. Pull-tab 28 may be of any size and shape, such as rectangular or oval. Preferably, pull-tab 28 is large enough to cover over a key and is of weight, for example, two to three ounces to counterbalance the weight of the key chain, discussed further below. For aesthetic purposes, pull-tab 28 may also include a space for artistic indicia or other logo or design. Additionally, the pull-tab may also function as a time display, such as a clock 29 shown in FIG. 6.

Pull-tab 28 may also be suspended from it's own flexible chain (or second flexible chain) 30. This second flexible chain 30 provides further weight for pull-tab 28 to act as a counterbalance to the weight of the flexible member and it's two ends and corresponding keys.

Also in the preferred embodiment, a generally centrally located connector 32 may be added to flexible chain 12 that is capable of receiving and removing at least one key. In preferred form, the connector is of a shape and size to receive an additional key 34 as shown in FIG. 1. Preferably, connector 32 includes a movable hinge member 36 that opens and closes a C-shaped member 38 that, when closed, defines a closed opening 40. When the hinge 36 is opened, an aperture 41 of ignition key 34 may be received onto the C-shaped member 38.

Connector 32 may be positioned generally opposite of pull-tab 28 at a common link 42, such as shown in FIG. 1. This provides maximum flexibility to hide the ignition key as well as the two ends 14, 16 when the key chain is in use.

Flexible chain 12 is preferably designed to be approximately 6–12 inches.

Although traditional jewelry chain is shown in the drawings, other flexible material such as leather or wire may be used instead of the chain. However, because the present invention is typically used in connection with a lady's handbag, aesthetics count. As such, it is envisioned that the particular chain is made from jewelry quality gold or silver-plated chain so as to appear to be part of the handbag, and, thus, appear to be decorative (or part of the handbag), while concealing its purpose of hiding any keys from view.

Referring to FIGS. 2–3, and 11–12, the present invention is designed to be used in conjunction with a container 46 defining at least one opening 48. In one use, the present invention is designed to externally wrap around a handle 44 of any container, such as a lady's handbag having a strap or handle (shown in FIG. 2). The pull-tab 28 and a central or hub portion 52 of flexible chain 12 externally wraps around handle 44 such that the balance of flexible chain 12, ends 14, 16, split rings 20 and any keys suspended from split rings 20, are suspended within opening 48 of container or purse 46 and are hidden from view. The weight of the keys 18, split rings 20, and balance of flexible member 12 act as a counterbalance to the pull-tab such that the keys stay put within the opening of the purse until the user accesses the pull-tab and key chain. Thus, the user does not need to fumble through the purse/container to locate the user's keys, especially when the user has her hands full or if the weather is inclement and the user needs to quickly access keys to find shelter whether the shelter is a car or home. Additionally, quick access to keys 18 may be even more comforting in dark or desolate places, such as a parking garage.

Referring to FIG. 3, a second use of the key chain is shown where the key chain is suspended from an upper edge 49 surrounding opening 48 of the container. The pull-tab 28 and the second flexible member 30 extend externally of the bag over the upper edge 49 and the flexible member 12, two ends 14, 16, split rings 20 and keys 18, as well as ignition key 34 and connector 32, suspend within opening 48. Pull-tab 28 and second flexible chain 30 act as a counterbalance to the weight of the keys and flexible member 12 on the external side of upper edge 49. This use is ideal for containers/purses that do not have a handle or that the handle is laterally offset from the container's opening.

As discussed above, the weight of the pull-tab 28 acts as a counterbalance and, as such, the pull-tab should preferably be between two to three ounces to counterbalance approximately ten keys. However, a lighter weight pull-tab can be used in connection with an upper edge of the container that includes a zipper (not shown) that closes opening 48. There, the two ends and any corresponding keys 18 suspend within opening 48 with pull-tab 28 positioned external of container at upper edge. The zipper can be used to restrain the key chain while positioned over the upper edge.

Referring also to FIGS. 11 and 12, a third use of the key chain is shown. The invention may be used in a container 46 having a partition 51 that divides opening 48 into at least two sub openings 53, 55. Here, central portion 52 either with or without pull-tab 28 and second flexible chain 30, spans partition 51 such that a portion of flexible chain 12 is allocated to both openings 53, 55. Thus, end 14 and its corresponding split ring and keys are on one side of the partition within opening 53 and end 16 and its split ring and corresponding keys 18 are in the other opening 55, where both ends and corresponding keys are substantially hidden from view.

Referring to FIG. 4, another feature of the present invention is that an ignition key 34 if placed at connector 32, when inserted into an ignition key receptacle will effectively fold flexible member 12 in half to effectively shorten flexible chain 12 when the ignition key is in use. This is because the connector is positioned generally centrally of the flexible member 12. As shown in FIG. 4, the pull-tab and the split rings are all approximately the same length which is approximately half the full longitudinal length of flexible member 12. In this manner, the key chain is not likely to interfere with the driver, which may not only be annoying but can be potentially dangerous and distracting to the driver.

Referring to FIGS. 5–9, the key chain of the present invention may take on various alternate forms. Referring to FIG. 5, pull-tab 28 may be made of a size and shape to conceal ignition key 34 and also be positioned on flexible chain 12 such that it will conceal ignition key 34 when the key chain 200 is positioned relative to the handbag or other container.

Figure 6:
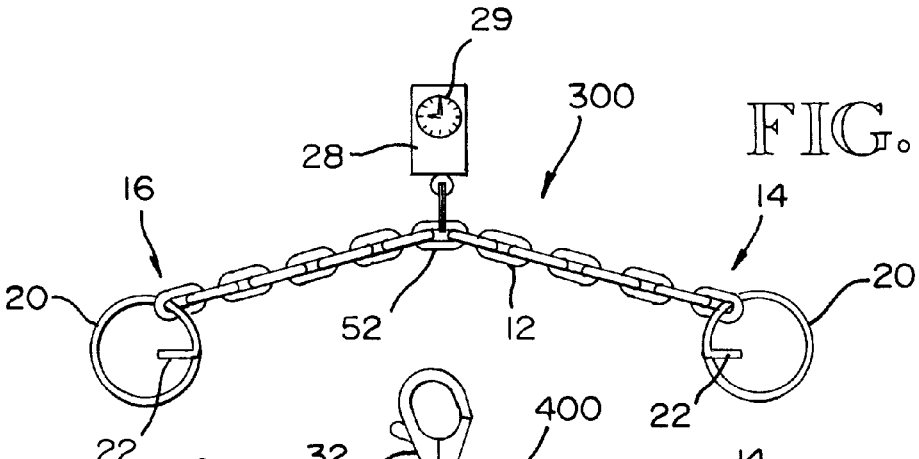
FIG. 6 is a front view of a second alternate embodiment of the present invention shown less the connector and only with the pull-tab, and with the pull-tab shown including a time display mechanism.

Referring to FIG. 6, alternate embodiment 300 provides only a pull-tab, and not a connector, as not all key users drive.

Figure 7:
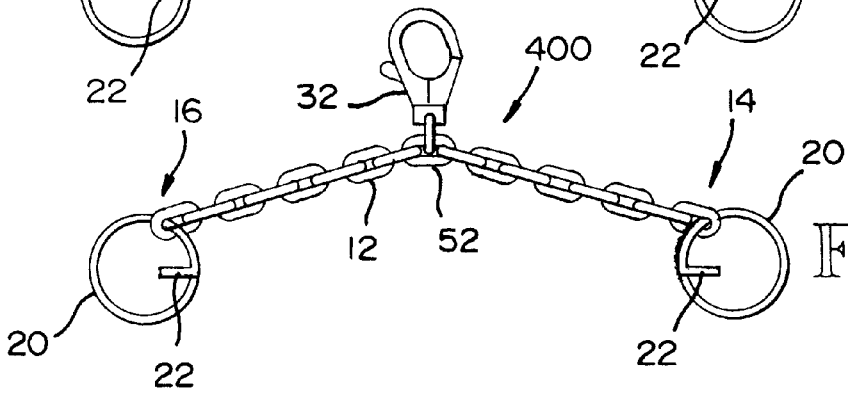
FIG. 7 is a front view of a third alternate embodiment shown less the pull-tab and only with the connector.

Referring to FIG. 7, another alternate embodiment 400 includes only the connector 32. The pull-tab is omitted. In this way, the ignition key is readily accessible or any other key or other item to be received on the C-shaped member.

Figure 8:
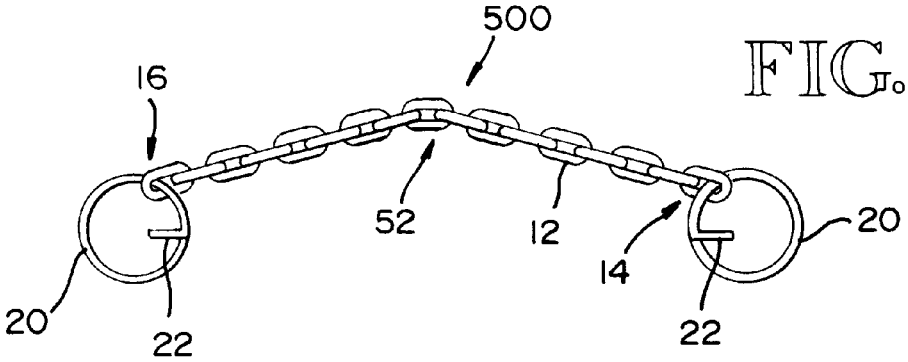
FIG. 8 is a front view of a fourth alternate embodiment wherein the flexible member is shown less the pull-tab and the connector.

FIG. 8 is the present invention in its purest form where there is no pull-tab or connector. This embodiment 500 is the least costly and may be used around a handle of a container (like in FIG. 2) or over a partition (like that shown in FIGS. 11 and 12).

Figure 9:
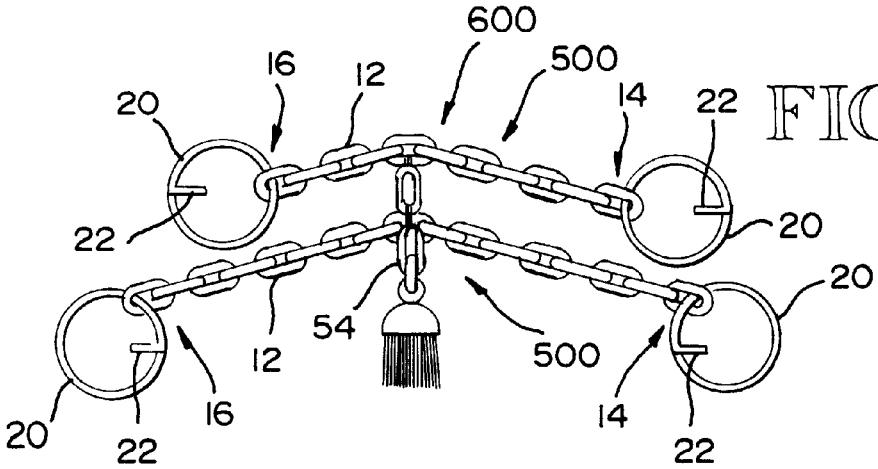
FIG. 9 is a front view of a fifth alternate embodiment disclosing two key chains like those of FIG. 8 connected together generally centrally by a common connector, such as a tassel as shown.

The fifth alternate embodiment is shown in FIG. 9 at "600" which is the combination of two key rings, such as that shown in the fourth embodiment at "500." Here, a generally central connector 54 connects the first key ring 500 to the second key ring 500. Such connector may be decorative, such as a tassel as shown. In this way, one who has a great number of keys may wrap the central portion 52 around a handle such as that shown in FIG. 2 with the tassel extending outward as a decorative feature. However, all four key rings may be used to accommodate a plurality of keys. One of the key chains 500 can be made shorter than the other (such as shown). The connector 54 can also be like that of connector 32 to easily add or remove the second chain, depending on the number of keys that the user carries.

The illustrated embodiments are only examples of the present invention and, therefore, are non-limitive. It is to be understood that many changes in the particular structure, materials and features of the invention may be made without departing from the spirit and scope of the invention. Therefore, it is Applicant's intention that her patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A key holder, comprising:

a first flexible member having a first free end and a second end;

a second flexible member having a first free end and a second end;

a third flexible member having a first free end and a second end;

a first key ring at the free end of said first flexible member;

a second key ring at the free end of said second flexible member;

a handle at said free end of said third flexible member;

said second ends of said first, second and third flexible members being connected together at a hub;

a third key ring connected to the flexible members generally at said hub;

wherein the key holder may be suspended from the third key ring and the first, second and third flexible members will hang from said hub, adjacent each other; and wherein said first, second and third flexible members are of sufficient length that the first and second flexible members, and the first, second and third key rings, can be positioned inside of a container, to be concealed within said container, and said third flexible member and said handle can be positioned outside of said container, so that the handle is readily accessible, for expedited removal of the key holder and keys from the container.

2. A key holder according to claim 1, wherein the flexible members are link chain.

3. A key holder according to claim 2, wherein the first and second flexible members are together a single continuous chain, and wherein the third flexible member is connected to a central link of said chain.

4. A key holder according to claim 1, wherein the handle is a counterweight for keys on the first and second key rings.

5. A key holder according to claim 4, wherein the handle comprises a body and a time display mechanism on the body.

6. A key holder according to claim 4, wherein the handle comprises a body that includes indicia.

* * * * *